US005943431A

United States Patent [19]

Weiss et al.

[11] Patent Number: 5,943,431

[45] **Date of Patent: *Aug. 24, 1999**

[54] LOUDSPEAKER WITH TAPERED SLOT COUPLER AND SOUND REPRODUCTION SYSTEM

[76] Inventors: Alan Weiss; Thomas Brown, both of 7548 W. McNab Rd. A3, North Lauderdale, Fla. 33069

[ * ] Notice: This patent issued on a continued prosecution application filed under 37 CFR 1.53(d), and is subject to the twenty year patent term provisions of 35 U.S.C. 154(a)(2).

[21] Appl. No.: 08/812,766

[22] Filed: Mar. 6, 1997

Related U.S. Application Data

[51] Int. Cl.[6] ..... H04R 25/00

[52] U.S. Cl. ..... 381/305; 381/354; 181/155

[58] Field of Search ..... 381/24, 158, 160, 381/159, 18–19, 27, 337, 354, 345, 332, 300, 305; 181/155, 156, 150

[56] References Cited

U.S. PATENT DOCUMENTS

| | | | |
|---|---|---|---|
| 2,816,619 | 12/1957 | Karlson | 181/27 |
| 2,896,736 | 7/1959 | Karlson | 181/30 |
| 3,540,544 | 11/1970 | Karlson | 181/31 |
| 4,230,905 | 10/1980 | Crum et al. . | |
| 4,701,951 | 10/1987 | Kash | 381/24 |
| 4,882,753 | 11/1989 | Shivers | 381/24 |
| 5,199,075 | 3/1993 | Fosgate | 381/24 |
| 5,251,260 | 10/1993 | Gates | 381/18 |
| 5,265,166 | 11/1993 | Madnick et al. | 381/27 |
| 5,446,792 | 8/1995 | Sango | 381/160 |
| 5,485,521 | 1/1996 | Yagisawa | 381/24 |
| 5,497,425 | 3/1996 | Rapoport | 381/18 |
| 5,533,129 | 7/1996 | Gefvert | 381/24 |
| 5,546,469 | 8/1996 | Donahoe | 381/152 |

*Primary Examiner*—Minsun Oh Harvey
*Attorney, Agent, or Firm*—Oltman, Flynn & Kubler

[57] ABSTRACT

In accordance with the invention, there is provided a tapered slot coupler combined with a loudspeaker for providing a high degree of uniform angular sound distribution in the horizontal plane, and a sharp cut-off above the horizontal plane through the coupler-speaker combination. It also sends a greater amount of sound energy to the furthest point of the domain and diminishing energy in direction to the interior of the domain as one comes closer and closer to the sound source. A sound reproduction system cooperating with the coupler-speaker combination has a receiving domain for receiving the sound, a perimeter defining the domain, and a plurality of tapered slot high and medium frequency coupler-speakers disposed proximal to the perimeter facing the domain, and a plurality of low frequency loudspeakers also disposed along the perimeter facing the domain, wherein the high/medium frequency loudspeakers are of the tapered slot coupler-speaker combination type. The invention includes sound-energy generating apparatus operative for feeding sound energy to the speakers.

6 Claims, 2 Drawing Sheets

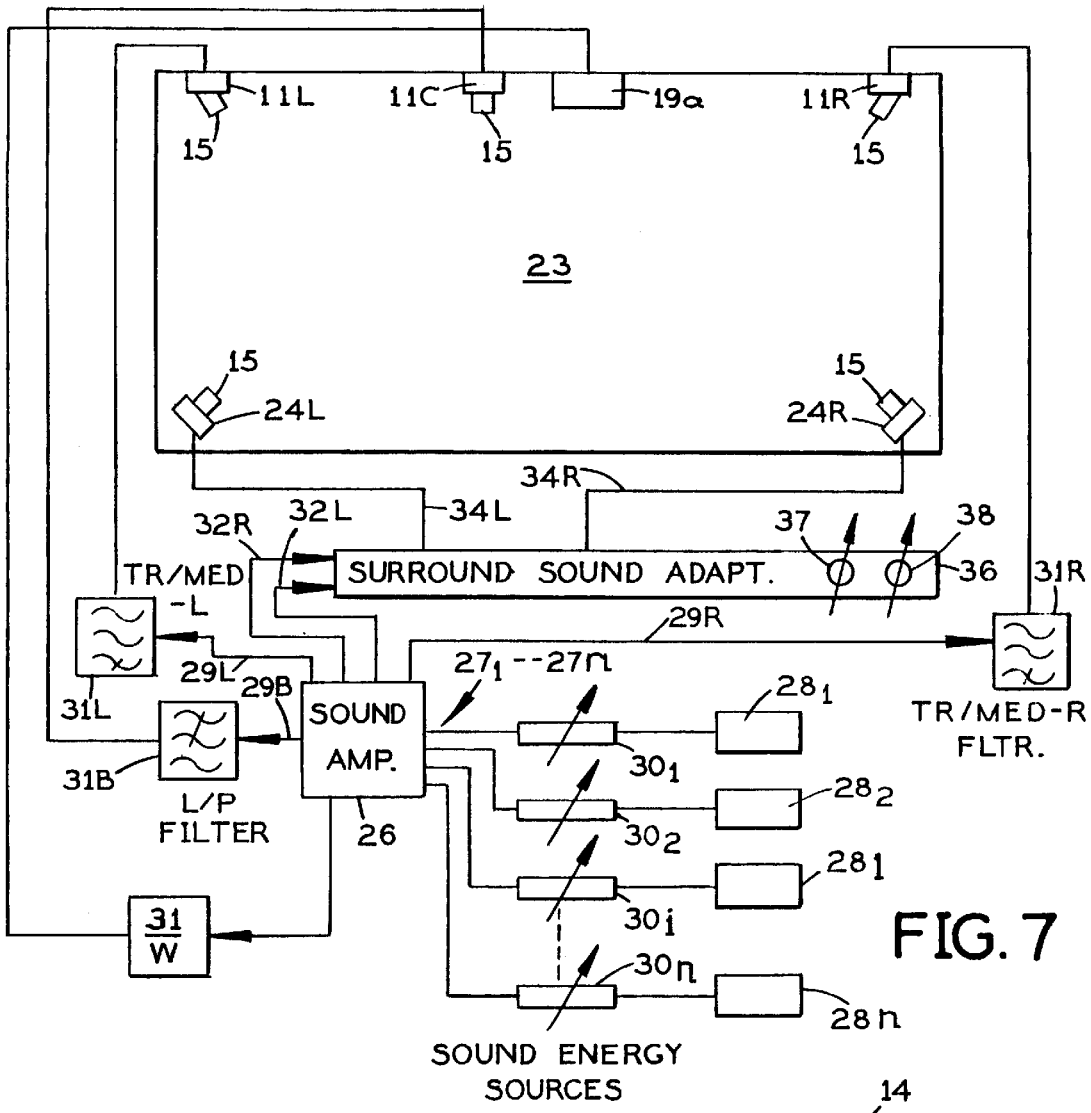
FIG. 7
FIG. 8
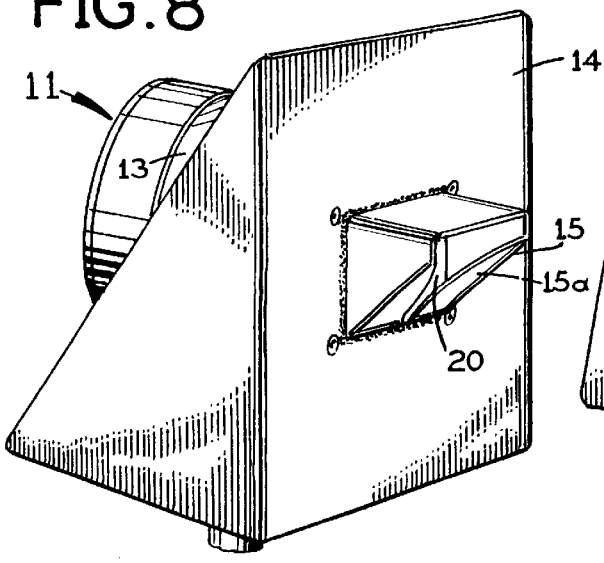
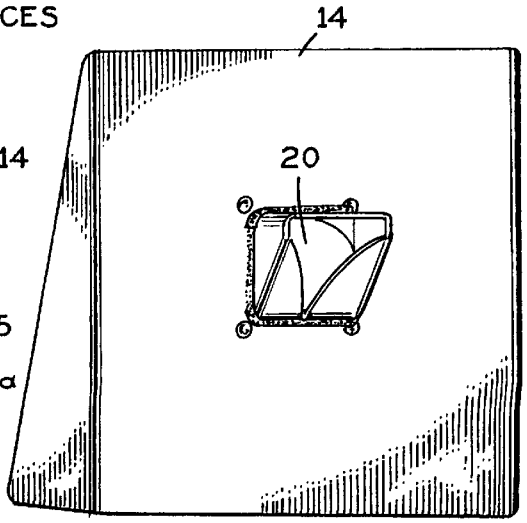
FIG. 9

LOUDSPEAKER WITH TAPERED SLOT COUPLER AND SOUND REPRODUCTION SYSTEM

The invention relates to a sound reproduction system which includes a plurality of loudspeakers with tapered slot couplers for attaining a high degree of fidelity in a sound receiving domain.

BACKGROUND OF THE INVENTION AND RELATED ART

The invention is directed to a sound reproduction system composed of a multiplicity of loudspeakers with tapered slot couplers driven by a sound energy generating arrangement. The sound receiving domain may include a concert hall, auditorium, an open air arena, living rooms, dens or the like, wherein loud-speakers of different capabilities combine to generate a listening ambience being very close to that of a real performing ensemble of musical performers and instruments.

One of the major elements of the invention is a so-called tapered slot coupler connected with the loudspeaker. Tapered slot speakers are disclosed in U.S. Pat. Nos. 2,816,629; 2,896,736; and 3,540,544.

Such tapered slot speakers have been found to generate an improved sound distribution pattern with wider angle dispersion within a wider frequency range, except for the low frequencies e.g. in the range from 50 to 200 hertz, the so-called bass range.

Conventional speakers for large listening areas are highly directional and are bulky and deficient in reproducing a flat frequency spectrum due to unavoidable mechanical resonances and standing waves in the speaker structure.

The prior art shows various sound reproducing systems wherein various forms of loudspeakers are combined to form enhanced sound reproduction systems.

U.S. Pat. No. 5,199,075 discloses a listening area which is served by a set of left and right speakers and a center speaker augmented by respective combination speakers that also include rearwardly slanted left and right speakers for generating a reflected sound wave "surround sound" effect.

U.S. Pat. No. 4,882,753 shows a multichannel stereophonic speaker system wherein different audio signals are produced which are caused to converge on a listening site in an enclosure.

U.S. Pat. No. 4,230,905 shows a stereophonic system which includes a pair of right and left channel sub-bass speakers in addition to the usual right and left channel main speakers.

The known sound reproduction systems all are based on the effect of mixing and blending the sound waves generated by variously configured speaker systems. Such blending of sound signals of different wavelengths from different speakers of the conventional types has the undesirable effect of creating areas of standing waves at discrete frequencies that leads to uneven sound distribution within the listening area. This effect is especially pronounced in a large enclosed area holding a large audience of listeners.

In accordance with the conventional systems, there is provided an acoustic sound system which has the directional effect of conventional speakers and their inherent cone of sound which is created by a dispersion pattern which becomes narrower as the frequency increases, as shown in FIG. 3. In contrast, speakers with tapered slot couplers have a dispersion which is uniform in its characteristics of radiation. Very little variation in sound distribution occurs with changes of frequency, as shown in FIG. 4.

Using speakers with tapered slot couplers with uniform high frequency dispersion have the further advantage that the sound energy is cut off above a horizontal plane 25 through the coupler. This allows a controlled sound pattern to the portion of the area to be covered from the speaker to receive a greater volume of sound energy. For that reason, the greatest energy is transmitted to the farthest point, and as one gets closer to the speaker, less and less energy is emitted for that area. Thus, in essence, uniform volume levels covering the entire listening area is attained. Both the length and the width of the area is blanketed by uniform levels, as shown in FIG. 5.

Because large area coverage such as theaters, arenas, outdoor amphitheaters, stadiums, etc. are difficult to cover with adequate uniformity, the rear surround channels usually have many speakers in order to attain the required effect.

The distribution patterns created by conventional front radiator systems make some areas louder than others and leave some areas with very little sound, if any. They also cause great reflections and reverberations as the sound is bounced off of interior surfaces detracting from the desired effect. In addition, sound that should appear to issue from the rear is perceived to come from the sides, and instead of hearing one sound source, the listener hears many. Since there are several sound sources, the sound waves intertwine creating a muddy effect from both the original sound and subsequent reflections and echoes.

In contrast, the acoustic reality surround sound speaker system according to the invention, allows the entire audience to hear the desired surround sound effect. Wherever one sits, one will hear each channel at the desired level. All of the acoustic effects desired by the recording engineer are apparent and enhanced in the system, according to the invention.

It is accordingly an object of the instant invention to provide a sound reproducing system that includes multiple speakers of the type having a tapered slot coupler, in the following called a tapered slot coupler-speaker. This term is to be understood to mean a speaker with a tapered slot coupler. These speakers provide a high degree of sound fidelity within a listening area or domain of any size.

SUMMARY OF THE INVENTION

In accordance with the invention, there is provided a loudspeaker having a transducer for converting electrical energy to sound energy, and a coupler for coupling the sound energy to space connected with the transducer, the coupler including a coupler body projecting forwardly away from the transducer, the coupler body having an underside backwardly and downwardly sloping from a forward end of the coupler, and a tapered slot formed in the underside, the tapered slot tapering inward in direction away from the forward end, and communicating with the transducer for shaping a pattern of the sound energy radiating from the coupler.

According to a further feature, the tapered slot has inward and downward curved edges.

According to another feature, the coupler body has a shape as a right circular cylinder, facing away from the transducer, or the coupler body has a shape as an oblique circular cylinder facing away from the transducer.

According to still another feature, the coupler has a shape as a four-sided cylinder with a substantially rectangular cross-section.

Conventionally, the transducer includes a diaphragm having a moving coil for receiving the electrical energy attached to the apex of the speaker cone, but other transducer forms are known and are applicable to the present invention.

The loudspeaker according to the invention can include a sound board for supporting the speaker cone, and a sound aperture in the sound board acoustically communicating with the tapered slot coupler.

In accordance with the invention, there may be provided a sound reproduction system having a receiving domain for receiving the sound, a perimeter defining the domain, at least one bass frequency loudspeaker disposed proximal to the perimeter facing the domain, and a plurality of medium/treble frequency loudspeakers disposed at the perimeter facing the domain, wherein the medium/treble frequency loudspeakers are of the tapered slot coupler-speaker type, and further including sound-energy generating apparatus operative for feeding sound energy to the tapered slot coupler-speakers.

The sound reproduction system according to the invention further includes sound-energy generating apparatus having at least one sound amplifier with at least one input coupled to a sound energy source, and frequency filtering apparatus coupled to the sound amplifier operative for filtering the sound energy into at least a bass frequency and a medium/treble frequency.

The sound reproduction system according to the invention may further include a sound energy source which has at least a left and a right stereophonic sound channel, and wherein further the plurality of medium/treble frequency coupler-speakers are divided into at least a left and a right group of loudspeakers connected to a respective left and right channel of the sound-energy source.

Another object is to provide a sound reproduction system having front channels left, center and right, rear surround channels left and right, and a sub-woofer channel.

Further objects and advantages of this invention will be apparent from the following detailed description of a presently preferred embodiment which is illustrated schematically in the accompanying drawings.

BRIEF DESCRIPTION OF THE FIGURES

FIG. 7 is a top-down view of a listening domain arranged according to the invention and a block diagram of the major function blocks of an example of a surround sound reproducing system directed to the application of tapered slot coupler-speakers;

FIG. 8 is a perspective view of the tapered slot coupler-speaker showing the coupler and speaker frame;

FIG. 9 is a perspective view of the tapered slot coupler-speaker, slightly shifted in position from that of FIG. 8, for a more direct, frontal view of the tapered slot.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DESCRIPTION OF THE PREFERRED EMBODIMENTS

Figure 1:
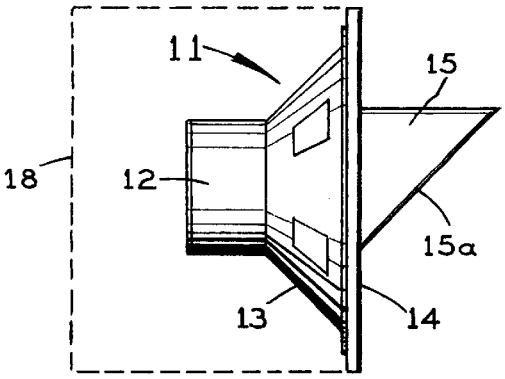
FIG. 1 is a side view of a tapered slot coupler-speaker.
Figure 2:
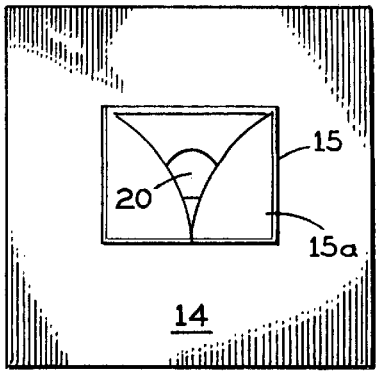
FIG. 2 is a front view of the tapered slot coupler-speaker of FIG. 1 seen along the line 2—2 of FIG. 1.

In FIG. 1 a tapered slot coupler-speaker with a sound driver of conventional construction has a magnet 12 attached to a speaker frame 13, which is in turn attached to a forward facing sound board 14 seen from the front in FIG. 2. A tapered slot coupler 15 having a tapered slot 20 is mounted forwardly projecting from the sound board 14. The coupler 15 has a rearwardly, backwardly and downwardly sloping underside 15*a*. In an alternative construction the speaker structure may be completely enclosed in a resonating box 18 shown in phantom lines. The box may be dimensioned so that the enclosed air mass coupled with the speaker diaphragm resonates at a certain selected frequency, or the box may be filled with dampening medium, not shown, so as to suppress resonance and standing waves, depending upon the particular speaker construction and desired frequency range.

The low frequency range from about very low-200 Hz is covered by a conventional low frequency or bass speaker with a large diaphragm.

Figure 3:
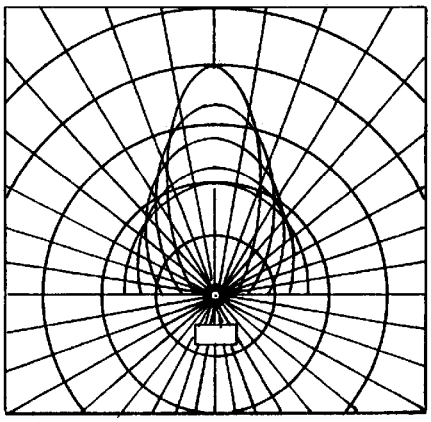
FIG. 3 is a diagrammatic view of a conventional loudspeaker showing the acoustic angular directivity at different frequencies.
Figure 4:
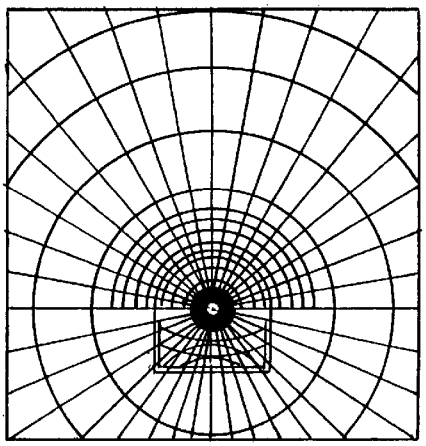
FIG. 4 is a diagrammatic view of the angular directivity of a tapered slot coupler-speaker having uniform angular directivity at different frequencies.

FIG. 3 shows, in a top-down view, radiation patterns at different frequencies in horizontal angular directions of a conventional loudspeaker, which contrasts with the angular horizontal radiation pattern of a tapered slot coupler-speaker, shown in FIG. 4.

Figure 5:
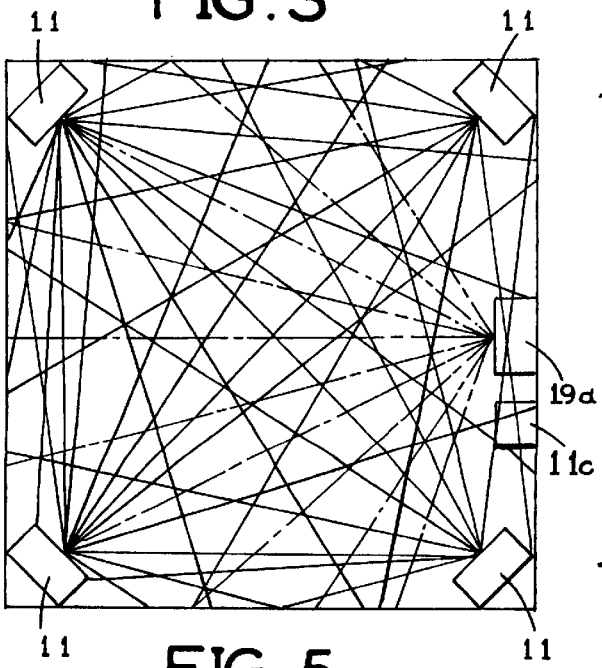
FIG. 5 is a top-down diagrammatic view of sound distribution within a listening domain receiving sound from peripheral tapered slot coupler-speakers.
Figure 6:
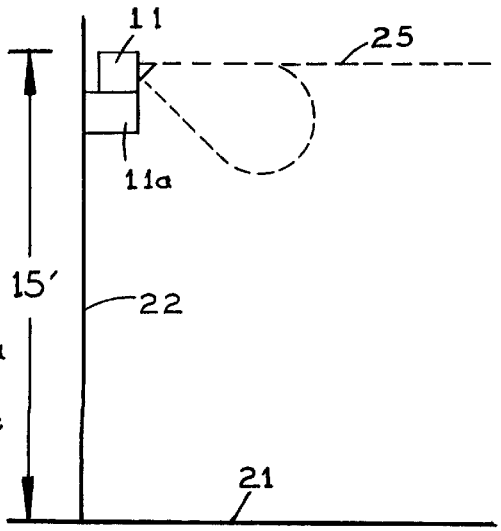
FIG. 6 is a side view of the vertically angular radiation pattern of a tapered slot coupler-speaker mounted above the floor of a listening domain.

FIG. 5 is a diagrammatic top-down view of a listening domain served by five separate channels with tapered slot coupler-speakers 11 advantageously combined with low-frequency speakers 11*a* as shown in FIG. 6. A single, very low frequency sub-woofer speaker 19*a* may also be provided. As seen in FIG. 6, the speakers 11 are advantageously, but not limited to being, mounted a given distance from the floor 21 on a wall 22, e.g. in a corner between two walls as seen in FIG. 5. FIG. 6 shows a typical vertical sound distribution pattern for a tapered slot coupler-speaker 11. As shown, due to a particular feature of the tapered slot coupler, there is a very sharp cut-off of sound energy at angles above the horizontal plane 25 through the coupler. This feature avoids loss of sound energy to the space above the coupler, and further avoids standing waves and unwanted sound reflections from ceiling and walls above the horizontal plane 25. The tapered slot coupler-speaker 11 is shown mounted at a height of 15' above the floor 21. The mounting height of the speakers is not critical, but depends on the size of the listening domain, but is typically in the range of 10 to 20 feet. Due to the dispersion of the sounds from the tapered slot speakers 11, a very wide and uniform distribution of the sounds in the listening area is attained. This effect greatly enhances the fidelity of the sound reproduction. Furthermore, a very desirable surround-sound effect is attained, since the sound is perceived as coming from all directions.

FIG. 7 is a block diagram of an example illustrating a typical electrical apparatus of the invention showing the listening domain 23, which may be an enclosed arena, auditorium, music hall, or an open area. A sub-woofer 19*a* is located at the center of one, e.g. the forward, wall flanked by the tapered slot left and right coupler-speakers 11L, 11R, and 11C center channel, and two further rear-mounted left and right tapered slot coupler-speakers 24L and 24R.

In a typical installation the tapered slot coupler-speaker 11 is arranged to handle the high and medium frequency range, and a low frequency speaker 11*a* is mounted in close proximity to the tapered slot coupler-speaker 11, as seen in FIG. 6.

The speakers 11L, 11R and 11C are shown with their respective couplers 15 angled inward toward the furthest point in the listening domain 23. Each tapered slot coupler-speaker 11L,R,C will usually be combined with a low frequency speaker 11*a*, usually mounted below the respective speakers 11L,R,C.

The tapered slot speakers 11L,11R and 11C, and 24L,24R may all be driven by respective channels of a sound amplifier 26 which has a plurality of sound input channels 27(1) - - 27(n) each connected to a respective sound receiver such as microphones, recorded sound devices, electrical musical instruments, radio receivers 28(1) - - 28(n), movie surround sounds, home surround sounds and so forth. Each sound receiver 28(1) - - 28(n) may be equipped with respective level of control devices 30(1) - - 30(n) to enable proper balancing of the various input levels by a sound control technician. Some sound receivers may be paired to form respective left and right stereophonic sound channels in well-known manner. In this case the sound amplifier may be arranged with multiple channels, including left and right channels having outputs 29L (29 "left") and 29R (29 "right"). These channels are connected via respective frequency filters 31L and 31R that divide the medium and high frequency audio signals into separate channels and transmit them to respective tapered slot speakers 11L and 11R.

A separate sub-woofer channel 31*w* of very low frequency and high power drives a sub-woofer 19*a*.

It follows that the filters 31L, R and B may be arranged internally to the sound amplifier 26 and be an integral part of the amplifier.

The two corner-mounted surround-sound tapered slot rear speakers 24R and 24L are advantageously driven by dedicated surround sound outputs 32R ("right") and 32L ("left") via a dedicated surround sound adapter 36 having outputs 34R and 34L, each driving a respective tapered slot coupler-speaker 24R, 24L, which may allow some controlled degree of cross-coupling between the left and right channels and level controls of the surround sound channels for more realistic surround sound effect.

We claim:

1. A tapered slot coupler-speaker combination comprising a substantially flat sound board having a first side, an opposite second side and a centrally disposed sound aperture therethrough, a transducer for converting electrical energy to sound energy mounted to said first side of said sound board over said sound aperture, and a coupler for coupling the sound energy to space mounted to said second side of said sound board over said sound aperture and in acoustic communication with said transducer, the coupler including a coupler body having a top surface projecting forwardly away from said transducer and terminating at a forward distal edge, the coupler body having an underside backwardly and downwardly sloping from said forward distal edge, and a tapered slot integrally formed in said underside, said tapered slot tapering inward in direction away from said forward distal edge towards said second side of said sound board, and acoustically communicating with said transducer for shaping a pattern of the sound energy radiating from said coupler.

2. A coupler-speaker combination according to claim 1, wherein said tapered slot has inward and downward curved edges.

3. A coupler-speaker combination according to claim 2, wherein said coupler body has a shape as a right circular cylinder, facing away from said transducer.

4. A coupler-speaker combination according to claim 2, wherein said coupler body has a shape as an oblique circular cylinder facing away from said transducer.

5. A coupler-speaker combination according to claim 2, wherein said coupler has a shape as a four-sided cylinder with a substantially rectangular cross-section.

6. A coupler-speaker combination according to claim 1, wherein said transducer includes a speaker cone having a moving coil for receiving said electrical energy attached to an apex of said speaker cone.

* * * * *